United States Patent [19]

Bromley et al.

[11] Patent Number: 4,600,644

[45] Date of Patent: Jul. 15, 1986

[54] POLYESTER YARN, SELF-TEXTURING IN FABRIC FORM

[75] Inventors: James E. Bromley; John M. Chamberlin; Jing-peir Yu, all of Pensacola, Fla.

[73] Assignee: Monsanto Company, St. Louis, Mo.

[21] Appl. No.: 492,091

[22] Filed: May 12, 1983

Related U.S. Application Data

[63] Continuation-in-part of Ser. No. 387,085, Jun. 10, 1982, abandoned.

[51] Int. Cl.[4] ..... D02G 3/00

[52] U.S. Cl. ..... 428/399; 428/400

[58] Field of Search ..... 428/399, 400

[56] References Cited

U.S. PATENT DOCUMENTS

| | | | |
|---|---|---|---|
| 2,604,689 | 7/1952 | Hebeler | 28/82 |
| 2,979,883 | 4/1961 | Waltz | 57/140 |
| 2,980,492 | 4/1961 | Jamieson et al. | 18/54 |
| 3,199,281 | 8/1965 | Maerov et al. | 57/140 |
| 3,248,771 | 5/1966 | Hitomi et al. | 29/910 |
| 3,423,809 | 1/1969 | Schmitt | 28/72 |
| 3,452,132 | 6/1969 | Pitzl | 264/298 |
| 3,481,558 | 12/1969 | Davies | 242/159 |
| 3,587,220 | 6/1971 | Eagleston | 57/140 |
| 3,705,225 | 12/1972 | Taylor | 264/183 |
| 3,748,844 | 7/1973 | Pacofsky | 57/140 |
| 3,852,948 | 12/1974 | Ruddell et al. | 57/140 |
| 3,946,100 | 3/1976 | Davis et al. | 264/210 |
| 3,964,249 | 6/1976 | Werner et al. | 57/140 |
| 4,059,950 | 11/1977 | Negishi et al. | 57/140 |
| 4,156,071 | 5/1979 | Knox | 528/272 |
| 4,176,150 | 11/1979 | Bromley et al. | 264/168 |
| 4,185,062 | 1/1980 | Luzzato | 164/176 |
| 4,195,161 | 3/1980 | Davis et al. | 528/309 |
| 4,246,747 | 1/1981 | Plunkett et al. | 57/245 |
| 4,247,505 | 1/1981 | Jackson | 264/176 |
| 4,255,377 | 3/1981 | Daumit | 264/176 |
| 4,325,765 | 4/1982 | Yu et al. | 156/167 |

FOREIGN PATENT DOCUMENTS

| | | |
|---|---|---|
| 22339 | 3/1967 | Japan . |
| 54-147253 | 4/1976 | Japan . |
| 55-45816 | 6/1977 | Japan . |
| 1406698 | 7/1975 | United Kingdom . |
| 2003423 | 6/1979 | United Kingdom . |

*Primary Examiner*—Marion E. McCamish
*Attorney, Agent, or Firm*—Thomas N. Wallin

[57] ABSTRACT

A polyester yarn having filaments with aperiodic varying shrinkage levels along their lengths, the filaments having within-filament and between-filament shrinkage C.V.'s of at least 10%. The yarn may be made by conventional melt spinning within a critical narrow range of spinning speeds wherein yarn shrinkage decreases rapidly with spinning speed. A greige fabric incorporating the yarn as filling is textured by shrinking the unrestrained fabric, then heating the fabric sufficiently to cause the yarn to elongate.

19 Claims, 3 Drawing Figures

POLYESTER YARN, SELF-TEXTURING IN FABRIC FORM

BACKGROUND

This application is a continuation-in-part of U.S. patent application Ser. No. 387,085 filed June 10, 1982, now abandoned.

The invention relates to the art of producing a polyester yarn which develops texture after incorporation into a fabric. The term "polyester" as used herein means those polymers of fiber-forming molecular weight composed of at least 85% by weight of an ester of one or more dihydric alcohols and terephthalic acid. It is preferred that the polyester polymer consists essentially of poly(ethylene terephthalate). That is, the polymer is predominately poly(ethylene terephthalate) although minor amounts of other reactants, pigments, plasticizers or other additives can be incorporated in the polymer so long as this does not result in substantial interference with texture development in fabric form. Similarly, filaments having other characteristics (e.g., uniform shrinkage) or made from other polymers can be incorporated into the yarn bundle provided that they do not substantially interfere with texture development in fabric form.

The current standard commercial process for producing textured polyester yarns involves a two-step process wherein polyester yarn is melt-spun on a spinning machine, followed by a simultaneous draw-texturing operation performed on a separate draw-texturing machine. In addition to the substantial added manufacturing costs incurred because of the separate draw-texturing step, fabrics made from such yarns generally do not have an optimum soft hand, and are thus not suited for various fabric applications where a soft hand is particularly desirable.

Numerous attempts have been made to eliminate the separate draw-texturing step by combining in a single yarn polyester filaments having high shrinkage with polyester filaments having low shrinkage, either by plying different yarns or more typically by expensive and elaborate modifications to the melt-spinning machine so that some filaments are subjected to different treatment than other filaments destined for the same yarn bundle. Exemplary references directed to this approach are Waltz U.S. Pat. No. 2,979,883; Jamison U.S. Pat. No. 2,980,492; Schmitt U.S. Pat. No. 3,423,809; Reese U.S. Pat. No. 3,444,681; and Plunkett U.S. Pat. No. 4,246,747. Insofar as is known, no such products or processes have ever achieved commercial acceptance in the marketplace. This is not surprising due to the excessive capital costs of the modifications to the spinning machine, the difficulty of controlling the different treatments, and to inferior cover and hand when many such yarns are formed into fabrics.

It is more recently known, as disclosed in British Specification No. 2,003,423, to produce a polyester yarn having latent crimp by merging molten sub-streams into a combined stream below the spinneret face, the sub-streams having different speeds so that a regularly repetitive oscillation occurs just below the spinneret face. The filaments quenched from the combined streams have regularly recurring high and low shrinkage regions along their lengths, the high and low shrinkage regions being out of phase from filament to filament. The resulting yarn, when incorporated into a fabric which is then boiled in water, develops texture, producing a fabric with a distinctive soft, luxuriant hand unattainable by use of the conventional false-twist heat-set yarns. In contrast to the processes and yarns described in the preceding paragraph, the processes and yarns described in this paragraph are commercially practical and are currently in commercial use.

While the process and product of British Specification No. 2,003,423 are superior to the noted conventional yarns in both manufacturing cost and in resulting fabric cover and hand, there are nonetheless certain disadvantages associated with the British Specification's process and product. For example, the special spinneret used is quite expensive and difficult to manufacture, and the filament cross-sections available are quite limited.

BRIEF SUMMARY OF THE INVENTION

In accordance with certain of the broader aspects of the invention, there is provided a yarn which is loop-forming as below defined. When loop-forming yarns are incorporated into fabrics which are finished as taught herein, the fabric does not have the rather slick hand of fabrics formed from flat (untextured) yarns. Loop-forming yarns according to preferred aspects of the invention provide fabric hands comparable to or even superior to those of the British Specification, and much superior to those made from conventional false-twist textured yarn.

In accordance with certain of these preferred aspects, there are provided critically selected spinning process parameters, yielding a yarn which in fabric form provides a soft, luxuriant hand comparable to that of the British Specification while permitting much greater freedom in selection of spinneret capillary design and filament cross-section. Accordingly, superior covering power in fabric form is made possible, as well as a wide range of other effects, such as moisture transport, increased glitter or anti-glitter effects, etc., which are not readily obtainable according to the process of the British Specification. Specifically, it has been discovered that by normal melt-spinning using a conventional spinneret (one which does not produce regular oscillations below the spinneret face), the spinning being with a critically selected spinning speed range such that the resulting filaments have an elongation between 50% and 130% (preferably between 65% and 100%) and a shrinkage between about 3.5 and 25% (preferably between 5 and 18%), the yarn is self-texturing in fabric form to give a very soft, luxuriant hand if the fabric is treated as disclosed hereinbelow. This is true even though the yarn per se may have no substantial crimp development by conventional tests, and even if each filament is nominally treated the same during the spinning process, with no effort to make some filaments have properties different from those of other filaments. The resulting finished fabric has a distinctly cotton-like hand as opposed to a wool-like hand.

The development of substantial texture in fabric form from a yarn possessing no substantial crimp development in yarn form is wholly unexpected.

THE DRAWINGS

The invention will be explained with reference to the drawings, in which.

DETAILED DESCRIPTION OF THE INVENTION

Figure 1:
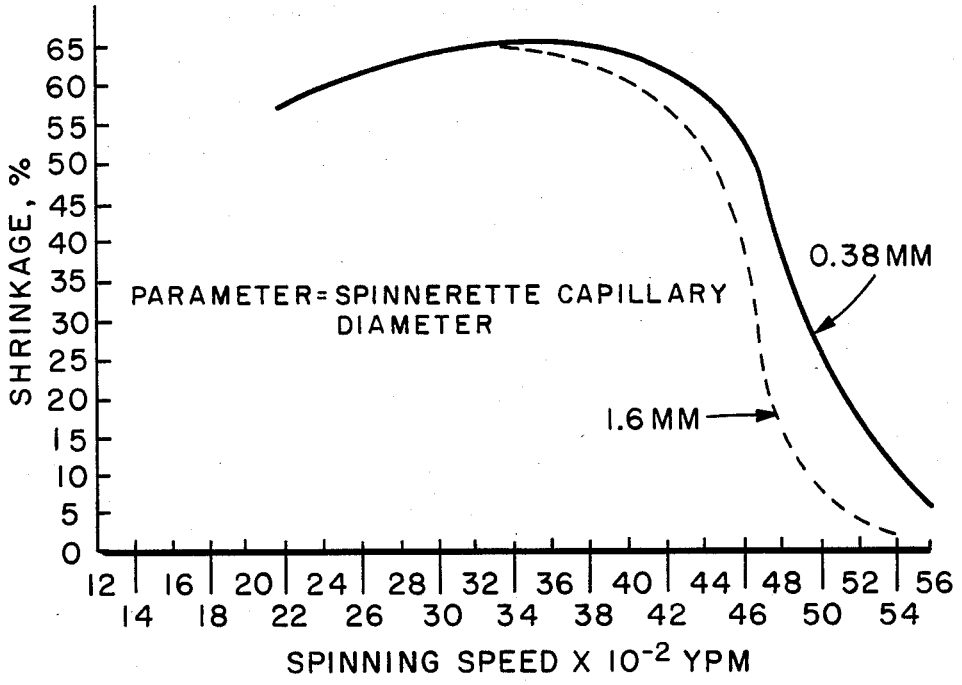
FIG. 1 is a graph showing the general effect of a changing spinneret capillary diameter on polyester shrinkage as a function of spinning speed.

According to a first major aspect of the invention, there is provided a package of yarn, the yarn consisting essentially of a plurality of polyester filaments having average shrinkages differing by less than 5%, said the yarn comprising a plurality of polyester filaments which vary aperiodically in shrinkage along their lengths, the aperiodic shrinkage variation resulting from use of a spinning speed within the range of from about 3300 to about 5000 meters per minute, the filaments having elongations between 50% and 130%, deniers less than 4.5 and non-round cross-sections with major-to-minor axis ratios of at least 1.2; the number of said filaments, the locations and amplitudes of the local shrinkage levels along the lengths of said filaments, and differences in local shrinkage levels between adjacent filament segments along the yarn being correlated such that the yarn is loop-forming.

The invention according to a second major aspect provides a package of loop-forming yarn, the yarn consisting essentially of a plurality of polyester filaments having average shrinkages differing by less than 5%, the yarn comprising a plurality of polyester continuous filaments having aperiodic within-filament shrinkage variations along their lengths, the aperiodic shrinkage variation resulting from use of a spinning speed within the range of from about 3300 to about 5000 meters per minute; within-filament and between-filament shrinkage C.V.'s of at least 10%; deniers less than 4.5; non-round cross-sections having major-to-minor axis ratios of at least 1.2; and elongations between 50% and 130%.

According to a third major aspect of the invention, there is provided a package of yarn produced by the process of extruding at a given rate a plurality of molten streams of polyester polymer through spinneret capillaries; quenching the molten streams into filaments; withdrawing the filaments from the molten streams at a given spinning speed; merging the filaments into the yarn; and winding said yarn on a package; the rate, the capillaries, and the spinning speed being selected such that the yarn wound on said package consists essentially of a plurality of polyester filaments having average shrinkages differing by less than 5%; has a shrinkage between about 3.5 and 25% and a restrained bulk greater than unrestrained bulk; and comprises filaments having aperiodic within-filament shrinkage variations along their lengths, deniers less than 4.5, non-round cross-sections with major-to-minor axis ratios of at least 1.2, and elongations between 50% and 130%.

According to a fourth major aspect of the invention, there is provided a process for making a loop-forming yarn, the process comprising extruding at a given rate a plurality of molten streams of polyester polymer through spinneret capillaries; quenching the molten streams into filaments; withdrawing the filaments from the molten streams at a given spinning speed; merging the filaments into a yarn; and winding the yarn on a package; the rate, the capillaries, and the spinning speed being selected such that said yarn wound on the package has a shrinkage between about 3.5 and 25% and a restrained bulk greater than unrestrained bulk; consists essentially of a plurality of filaments having average shrinkages differing by less than 5%; and comprises filaments having aperiodic within-filament shrinkage variations along their lengths, deniers less than 4.5, non-round cross-sections havng major-to-minor axis ratios of at least 1.2 and elongations between 50 and 130%.

According to a fifth major aspect of the invention, there is provided a process for making a package of loop-forming yarn, the process comprising extruding at a given rate a plurality of molten streams of polyester polymer through spinneret capillaries; quenching the molten streams into filaments; withdrawing the filaments from the molten streams at a given spinning speed; merging the filaments into a yarn; and winding the yarn on a package; the rate, the capillaries, and the spinning speed being selected such that the yarn has a shrinkage between about 3.5 and 25% and consists essentially of a plurality of polyester filaments having average shrinkages differing by less than 5%; and the filaments have aperiodic within-filament shrinkage variations along their lengths, deniers less than 4.5, non-round cross-sections having major-to-minor axis ratios of at least 1.2 and elongations between 50% and 130%.

The reason for the remarkable phenomenon of the invention may be explained with reference to FIG. 1, which qualitatively shows how the shrinkage of poly(ethylene terephthalate) yarn falls quite rapidly over a narrow spinning speed range from very high values of some 50–70% at intermediate spinning speeds to very low values at somewhat higher spinning speeds. All other things being equal, the steep region of the shrinkage curve can be shifted to lower spinning speeds merely by increasing the jet stretch (defined as the filament speed after solidification divided by the speed of the molten polymer in the capillary producing that filament), as by increasing the capillary cross-sectional area or by decreasing the polymer metering rate. Conversely, the steep region may be shifted to higher spinning speeds by decreasing the capillary cross-sectional area or by increasing the polymer metering rate. For any given spinneret design and polymer metering rate, the desired yarn shrinkage as taught herein is readily obtained merely by selection of the appropriate spinning speed. This will generally be found between about 3300 meters per minute (MPM) and about 5000 MPM, depending on the jet stretch as noted above. Conventional quenching conditions are satisfactory.

Detailed analysis of the yarn reveals that filaments spun on the steep portion of the shrinkage curve unexpectedly have substantial aperiodic shrinkage variations along their lengths, with high within-filament and between-filament shrinkage coefficients of variation (C.V.'s). That is, comparison of the local percent shrinkages of adjacent filaments reveals that the shrinkage levels of adjacent filament segments are not identical, but rather vary independently from filament to filament along their lengths. It is believed that such variations in shrinkage result from the normal variations in operating conditions (speed, quench air flow, temperature, capillary variations) and polymer characteristics (viscosity, impurities, etc.) due to extreme process sensitivity in this steep portion. While spinning according to this invention provides self-bulking when the yarn is restrained at short intervals, the spinning does not provide self-bulking when unrestrained yarn is subjected to shrinkage. The local between-filament shrinkage coefficients, while sufficient to provide self-bulking within short intervals when the yarn is restrained, average out when a longer length of unrestrained yarn is subjected to shrinkage so that the yarn does not crimp or self-bulk due to these forces.

However, all yarns spun on the steep portions of the shrinkage curve do not have optimum properties for all applications, even though they have high shrinkage C.V.'s and are loop-forming, resulting in textured fabrics. According to some aspects of the invention where a particularly soft hand is desired, the spinning speed is selected such that the yarn has a shrinkage between about 3.5 and 25% (preferably between 5 and 18%), since if the yarn shrinkage is above 25%, the resulting fabric may have a harsh, "boardy" hand, while if the yarn has a shrinkage below about 3.5%, the resulting fabric may have less than optimum texture. The filaments have aperiodic shrinkage variations along their lengths, and, according to certain aspects of the invention, have within-filament and between-filament shrinkage C.V.'s of at least 10% (preferably at least 20%). Such aperiodic filament shrinkage variations and high shrinkage C.V.'s are obtained when spinning with conventional spinnerets within the critical spinning speed range to give the yarn shrinkage and elongation as taught herein. Generally speaking, increased C.V.'s are obtained at higher spinning speeds with concomitant reduced yarn shrinkage. The filaments must have deniers less than 4.5, and preferably have deniers between 1 and 3.7 (preferably below 3) and non-round cross-sections having major-to-minor axis ratios of at least 1.2 (preferably at least 1.5), if the optimum hand and cover are to be achieved. The specified non-round cross-sections of the yarns of the invention cooperate with the loop-forming characteristics of the yarn to provide the utlimately achieved soft hand and cover. The filaments preferably have elongations between 50% and 130%, and densities between 1.355 and 1.377 (preferably between 1.357 and 1.372).

The invention further provides, as a sixth major aspect, a process for producing a fabric from a greige fabric comprising a yarn comprising a plurality of poly(ethylene terephthalate) filaments which vary aperiodically in shrinkage along their lengths, the aperiodic shrinkage variation resulting from use of a spinning speed within the range of from about 3300 to about 5000 meters per minute; the filaments having deniers less than 4.5; the number of the filaments, the locations and amplitudes of the local shrinkage levels along the lengths of the filaments, and differences in local shrinkage between adjacent filament segments along the yarn being correlated such the yarn is loop-forming, the process comprising shrinking the fabric to provide a shrunken dimension in the direction; and heat-setting the fabric at a temperature sufficiently high and for a time sufficiently long to cause the fabric to grow in the direction to a larger dimension than the shrunken dimension.

The invention further provides, as a seventh major aspect, a process for producing a fabric having a soft hand from a greige fabric comprising a loop-forming yarn extending in a given direction along a given dimension of the fabric, the yarn having a shrinkage between about 3.5 and 25%, the yarn comprising a plurality of polyester continuous filaments, the filaments having aperiodic within-filament shrinkage variations along their lengths, the aperiodic shrinkage variation resulting from use of a spinning speed within the range of from about 3300 to about 5000 meters per minute, deniers less than 4.5 and within-filament and between-filament shrinkage C.V.'s of at least 10%; the process comprising shrinking the fabric to provide a shrunken dimension in the given direction and heat-setting the fabric at a temperature sufficiently high and for a time sufficiently long to cause the fabric to grow in the given direction to a larger dimension than the shrunken dimension. That is, the fabric process in its simplest form merely requires shrinking the greige fabric and then heat setting it. The use of non-round yarns of the invention is preferred; however, other cross-sectional shapes can be employed, if desired.

According to an eighth major aspect of the invention, there is provided a process for producing a fabric having a soft hand, comprising providing a greige fabric comprising a yarn extending in a given direction along a given dimension of the fabric, the yarn having been formed by a process comprising extruding at a given rate a plurality of molten streams of polyester polymer through spinneret capillaries; quenching the molten streams into filaments; withdrawing the filaments from the molten streams at a given spinning speed; and merging the filaments into the yarn; the rate, the capillaries, and the spinning speed being selected such that the yarn has a shrinkage between about 3.5 and 25% and a restrained bulk at least 5% greater than unrestrained bulk; the yarn consists essentially of a plurality of filaments having average shrinkages differing by less than 5%; and a plurality of the filaments have aperiodic within-filament shrinkage variations along their lengths, deniers less than 4.5, and elongations between 50% and 130%; shrinking the fabric to provide a shrunken dimension in the direction; and heat-setting the fabric at a temperature sufficiently high and for a time sufficiently long to cause said fabric to grow in the direction to a larger dimension than the shrunken dimension.

The invention further provides, as a ninth major aspect, a greige fabric having latent texture comprising a yarn consisting essentially of a plurality of poly(ethylene terephthalate) filaments which vary aperiodically in shrinkage along their lengths, the aperiodic shrinkage variation resulting from use of a spinning speed within the range of from about 3300 to about 5000 meters per minute; said filaments having average shrinkages differing by less than 5%; said filaments having elongations between 50% and 130% and deniers less than 4.5; the number of said filaments, the locations and amplitudes of the local shrinkage levels along the lengths of said filaments, and differences in local shrinkage levels between adjacent filament segments along said yarn being correlated such that said yarn is loop-forming.

The invention further provides, as a tenth major aspect, a greige fabric having latent texture comprising a loop-forming yarn extending in a given direction along a given dimension of the fabric, the yarn having a shrinkage between about 3.5 and 25%, the yarn consisting essentially of a plurality of polyester continuous filaments, the filaments having aperiodic shrinkage variations along their lengths, the aperiodic shrinkage variation resulting from use of a spinning speed within the range of from about 3300 to about 5000 meters per minute; within-filament and between-filament shrinkage C.V.'s of at least 10%; and deniers less than 4.5; elongations between 50% and 130%; and average shrinkages differing by less than 5%. Such fabric can be made by forming yarn as above described or otherwise similar yarn of other cross-section (e.g., round, polylobal, etc.) into fabric by knitting, weaving, or other conventional means.

According to an eleventh major aspect of the invention, there is provided a greige fabric having latent texture comprising a yarn extending in a given direction along a given dimension of the fabric, the yarn having been formed by a process comprising extruding at a given rate a plurality of molten streams of polyester polymer through spinneret capillaries; quenching the molten streams into filaments; withdrawing the filaments from the molten streams at a given spinning speed; merging the filaments into the yarn; and winding said yarn on a package; the rate, the capillaries, and the spinning speed being selected such that the yarn on the package has a shrinkage between about 3.5 and 25% and a restrained bulk at least 5% greater than unrestrained bulk; consists essentially of a plurality of filaments having average shrinkages differing by less than 5%; and comprises filaments having aperiodic within-filament shrinkage variations along their lengths, deniers less than 4.5, and elongations between 50% and 130%.

EXAMPLE I

This is a comparative example in which poly(ethylene terephthalate) yarn is produced as in the above-noted British Specification, except that the yarn count is adjusted to 165 denier, 68 filaments for comparison purposes, and the spinning speed is 5000 YPM (approximately 4500 meters per minute). The yarn has substantial (e.g., above 3%) crimp development, when tested as set forth below. Accordingly, one would expect fabric made therefrom to develop texture. The yarn is woven as filling across a standard commercial polyester-cotton warp to provide a greige width of 46.5 inches (118 cm.). The resulting fabric is scoured at the boil while permitting it to freely shrink, then dyed at the boil while similarly unrestrained, resulting in a shrunken width (the dimension in the filling direction) of 37½ inches (95 cm.). The fabric is tentered (stretched in the filling direction) at room temperature to a stretched width of 41 inches (104 cm.), then heat-set for 30 seconds at 180° C. During the heat-setting step, the fabric spontaneously increases in width (the filling direction) by several percent, due to crystallization of the filling yarn.

The resulting fabric has an unusually luxuriant, soft hand, and is assigned a subjective hand rating of 5 on a scale of 1 to 5 by a skilled fabric technologist experienced in evaluating fabric hand properties. On this scale, a rating of 1 represents the very poor, slick hand of a fabric wherein the filling yarn is untextured, and a fabric wherein the filling yarn is a conventional false-twist textured yarn of the same denier and filament count would have a rating of about 3.

EXAMPLE II

This is an example of the several aspects of the invention. Poly(ethylene terephthalate) polymer of normal molecular weight for apparel end use is melt spun at a temperature of 288° C. The spinneret has 68 spiral capillaries 26 of the type shown in FIG. 3, which is approximately to scale, the widths 28 of the capillary slots being 0.0045 inch (0.11 mm.), the lengths of the slots being 0.154 inch (3.9 mm.), the slots extending over spirals at about 480° C. The molten streams are solidified into filaments in a quench zone 45 inches (114 cm.) in height, the quench zone being conventionally supplied with transversely directed room temperature air having an average velocity of about 1 foot (30 cm.) per second. The solidified filaments are withdrawn from the molten streams at a spinning speed of about 3500 ypm to give a yarn shrinkage of about 11.3% and a yarn elongation of 71%, with the polymer extrusion rate selected to give a total yarn denier of 165 and filament elongations of about 71%. A conventional spin-finish is applied prior to windup. The filaments each have average shrinkages of about 11.3%, deniers of about 2.4 and aperiodic shrinkage variations along their lengths and from filament to filament, the coefficients of variation of shrinkage being greater than 12%, both within-filament and between-filament. The yarn has no substantial crimp development, e.g., 0.4% when tested as set forth below, and would accordingly be expected to yield a fabric with a slick hand. The yarn is loopforming, and the filaments have densities between 1.357 and 1.372.

The yarn is then woven as filling across a further portion of the same polyester-cotton warp as in Example I to form a greige fabric. A first portion of the greige fabric is then scoured and dyed as in Example I, during which the fabric shrinks more than 12% in width from its greige dimensions of 46½ inches (118 cm.). A first portion of the dyed fabric is tentered to a width ½ inch (1.27 cm.) wider than the shrunken width, then heat-set at 356° F. (180° C.) for 30 seconds, during which the fabric grows in the filling direction more than 4%, as compared with the shrunken width. The finished heat-set fabric is judged to have a subjective hand rating substantially equal to the fabric in Example I above, and to have superior moisture transport and covering power.

A second portion of the dyed fabric of this example is tentered by an amount of ¾ the amount by which the fabric has previously shrunk, then heat-set at 180° C. for 30 seconds. The hand of this fabric is noticeably inferior to that of the fabric in the preceding paragraph above, being judged to have a subjective hand rating of only 3–3.5. This illustrates that the shrunken fabric should not be stretched prior to heat-setting an amount more than 60% of the amount by which it shrinks during scouring and dyeing. That is, if the fabric shrinks 10 cm., it should be stretched no more than 6 cm. prior to heat-setting. With some combinatiosn of yarns according to the invention and fabric constructions, no tentering prior to heat-setting gives the softest hand, but with others a small amount of tentering (about 1/10 of the amount by which the fabric shrank) gives the softest hand.

A second portion of the greige fabric of this example is tentered (prevented from shrinking) during the heating operations. The resulting fabric has a comparatively slick hand, demonstrating that the fabric must be allowed to shrink during the finishing operation if the desired soft hand is to be achieved.

A third portion of the dyed (shrunken) fabric of this example is made into a shirt without having been heat-set. The shirt is unsatisfactory due to instability of the fabric. This demonstrates the necessity of heating the shrunken fabric at a temperature sufficiently high and for a time sufficiently long to cause the fabric to grow in the filling direction to a larger width than the shrunken width.

EXAMPLE III

Example II is repeated, except the spinning speed is increased sufficiently to provide a yarn shrinkage of 3%. The yarn is woven, scoured, dyed and heat-set as in the second paragraph of Example II above. The resulting finished fabric has a somewhat "plastic" hand, as compared to the fabric processed according to the second paragraph of Example II above, although still superior to a similar fabric using a flat polyester yarn as filling.

EXAMPLE IV

Example III is repeated, except the spinning speed is reduced sufficiently to provide a yarn shrinkage of 30%. The resulting finished fabric has excellent texture but a somewhat "boardy" hand as compared to the fabric processed according to the second paragraph of Example II above.

EXAMPLE V

Example II is repeated except that the spinneret capillaries are conventional circular orifices, the diameters being 0.009 inch (0.23 mm.) and the lengths being 0.012 inch (0.30 mm.). The polymer metering rate and spinning speed are adjusted to produce a yarn having 165 denier and 68 filaments, with a yarn shrinkage of 10% and filament elongations between 50% and 130%.

The yarn is woven scoured and dyed, tentered and heat-set as in Example II. The resulting fabric has a soft hand distinctly superior to similar fabric made from a conventional false-twist textured yarn of the same denier and number of filaments. Analysis of the yarn shows that the filaments are similar to those in Example II in having aperiodic shrinkage variations along their lengths, and within-filament and between-filament shrinkage C.V.'s of more than 10%.

While fabrics made from such yarns have a desirable soft hand, and are within certain broader aspects of the invention, they lack the covering power and ultimate softness of those prepared from yarns of the invention wherein the filaments have non-round cross-sections with major-to-minor axis ratios of at least 1.2.

EXAMPLE VI

This example illustrates that capillaries need not be identical in producing fabrics of the invention. Example II is repeated using a spinneret having 34 capillaries with diameters of 0.009 inch (0.23 mm.) and lengths of 0.032 inch (0.81 mm.), and also having 34 capillaries with diameters of 0.016 inch (0.41 mm.) and lengths of 0.146 inch (3.7 mm.). Adjusting the polymer metering rate to maintain the yarn denier constant at about 160–170, yarns are produced at 100 YPM (91 MPM) increments of spinning speed over the range of 3500 YPM (3200 MPM) to 4800 YPM (4389 MPM).

Each yarn is woven as filling across the standard polyester-cotton warp as in Example II to produce fabrics. Each fabric is then scoured and dyed at the boil while tensionless, tentered an amount of one-third the amount by which it shrinks during the scouring and dyeing operations, then heat-set at 350° F. for 30 seconds.

Only those fabrics made from yarns spun at 4100 YPM (3749 MPM) to 4300 YPM (3932 MPM) have the most desirable hand, nearly equivalent to fabrics made according to Example I. With the particular spinneret of this example, spinning 160–170 denier yarn at below 4000 YPM (3658 MPM) results in a finished fabric with a hard, stiff hand while spinning at above 4400 YPM (4023 MPM) results in a finished fabric with a relatively slick hand as compared to the Example I fabrics. The yarns spun at 4100 YPM (3749 MPM) have a shrinkage of 9.9%, while the filaments have within-filament and between-filament shrinkage C.V.'s of 21.2% and elongations of about 93%.

Other combinations of capillary designs in the same spinneret may be used, including mixed round and non-round capillaries, in accordance with the broader aspects of the invention, so long as the polymer metering rate and spinning speed are selected to give the yarn and filament characteristics as taught herein. However the most desirable fabrics result when the capillaries are designed such that all filaments have non-round cross-sections having major-to-minor axis ratios greater than 1.2, and preferably greater than 1.5. As noted above, the spiral cross-section is particularly preferred. The term "spiral cross-section" as used in the claims includes cross-sections wherein the inner end of the spiral joins an intermediate portion of the spiral, as in the arabic numeral 6.

The self-texturing yarn of this invention can be dyed substantially uniformly. The self-texturing capability does not require capillaries of different sizes or that filaments from more than on capillary be fused during spining. All capillaries can be substantially the same size and each filament can be withdrawn from a single capillary. All filaments can be of the same polymer so that a homogeneous polymer melt can be employed and all filaments can be subjected to essentially the same cooling conditions, which can, if desired, be chosen to uniformly cool the filament across its cross-section. While the practice of this invention can be employed in conjunction with prior art techniques that themselves tend to provide some crimp, such prior art techniques are not required in order to obtain the loop-forming ability of the yarn of this invention.

DEFINITIONS

Figure 2:
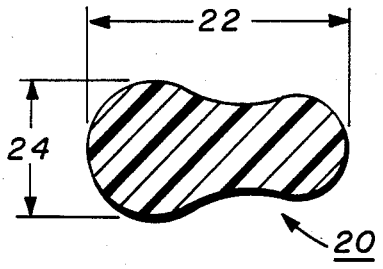
FIG. 2 is a cross-sectional view of a generalized exemplary filament according to the invention.
Figure 3:
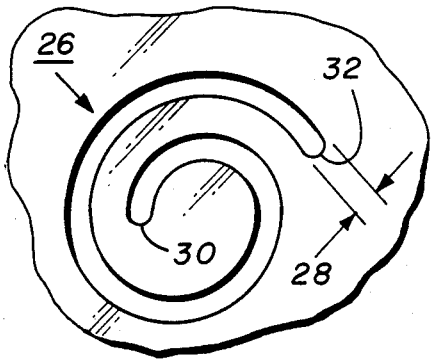
FIG. 3 is a plan view of the preferred spinneret capillary used in the invention.

The "major-to-minor axis ratio" may be explained with reference to FIGS. 2 and 3. The largest transverse dimension of the filament is the length 22 of the major axis in FIG. 2, while the largest transverse dimension of the filament in the perpendicular direction is the length 24 of the minor axis. The ratio of length 22 to length 24, expressed as a decimal number, is the ratio. In cases wherein the filament cross-section is in the form of a curved figure, the major axis is taken as the curved length. For example if the filament had the shape of orifice 26 in FIG. 3, the major axis would be taken as the spiral length from point 30 to point 32, while the minor axis would be the widest dimension transverse to the curved length, in this case, dimension 28.

Yarn shrinkage, crimp development, and unrestrained bulk properties are determined by preparing a $1\frac{1}{8}$ meter circumference skein of approximately 8000 skein denier from the yarn using a Suter denier reel or equivalent. The length L0 of the skein is measured while the skein is supporting a weight equal to 0.0025 grams per skein denier. The skein with the weight suspended therefrom is placed in a hot air oven maintained at 120° C. for 5 minutes. The skein is then removed from the oven and conditioned for 1 minute at 21° C. and 65% relative humidity, after which the skein length L1 is determined. The weight is then increased to provide a loading of 0.1 grams per skein denier, and 30 seconds thereafter the skein length L2 is determined. Yarn percent shrinkage is defined as 100(L0-L2)/L0, and yarn crimp development is defined as 100(L2-L1)/L2. Yarn unrestrained bulk is defined as 100(L0-L1)/L0.

Yarn restrained bulk is determined as follows. The filaments of the yarn are bound tightly together at points spaced at 5 mm. intervals along the yarn, by small separate pieces of yarn encircling and tied about the yarn while the yarn is subjected to a tension of 0.1 gram per denier. The yarn is then formed into a 1-$\frac{1}{8}$ meter circumference skein of approximately 8000 skein denier using a Suter denier reel or equivalent. The length La of the skein is measured while the skein is supporting a weight equal to 0.0025 grams per skein denier. The skein with the weight suspended therefrom is placed in a hot air oven maintained at 120° C. for 5 minutes. The skein is then removed from the oven and conditioned for 1 minute at 21° C. and 65% relative humidity, after which the skein length Lb is determined. Yarn restrained bulk is defined as 100(La-Lb/La).

Filament elongation is determined with a conventional Instron instrument, using a 12.5 cm. sample original length and a 30 cm./minute rate of extension. A filament is carefully separated from the yarn so as to avoid stretching the filament. Percentage elongation value as used herein is 100 times the length by which the individual sample stretches before breaking divided by the sample original length. Twenty successive samples along the length of the filament are measured, and the ten smaller percentage elongation values are discarded. The remaining ten percentage elongation values are then averaged to arrive at the percentage elongation characterizing the filament.

Yarn elongation is determined with a conventional Instron instrument, using a 12.5 cm. sample original length and a 30 cm./minute rate of extension. Percentage elongation value as used herein is 100 times the length by which the yarn sample stretches before the first filament breaks, divided by the sample original length.

Filament local shrinkage properties of individual filaments are determined as follows. A 5 yard (4.57 meter) yarn sample is cut from the yarn. A knot is tied in each individual filament at one end of the yarn sample, after which the remainder of the yarn sample is carefully separated into individual filaments so as to avoid stretching the filaments. Small pieces of paper masking tape 0.125 inches (0.32 cm.) square are adhered with closest edges of successive tapes 5 inches (12.7 cm.) apart along each filament, beginning with the first tape 5 inches (12.7 cm.) from the knot. Each filament is heated while unrestrained in an oven at 120° C. for five minutes. Each filament is then removed from the oven and conditioned one minute at 21° C. and 65% relative humidity. The local shrinkage value for each filament segment between adjacent tapes is calculated from the filament segment lengths between closest edges of successive tapes before (Lb) and after (La) the heat treatment, as follows:

$$\% \text{ shrinkage} = 100(Lb\text{-}La)/Lb.$$

The local shrinkage values of successive segments along the length of each filament of the yarn sample are tabulated in sequential order, begining at the knotted end. In filaments according to the invention, the local shrinkage values fluctuate aperiodically along the filaments, with no readily discernible regularly recurring repetitive pattern. Comparison of the sequences of local shrinkage values of the filaments from the knotted end to the other end reveals that the variations in local shrinkage values from segment to segment along each filament according to the invention occur substantially independently of the variations of corresponding segments along the other filaments according to the invention. By "corresponding segments" is meant those segments located the same distance from the knots in the individual filaments before the filaments are placed in the oven. The local shrinkage values along each filament are analyzed to determine the within-filament C.V. percentage for that filament, and the local shrinkage values of corresponding segments of those filaments having within-filament shrinkage C.V.'s above 10% are analyzed to determine the between-filament C.V. percentage value for the yarn.

The term "C.V." means coefficient of variation, a standard statistical term defined, for example, in "Statistical Theory with Engineering Applications" by Hald, published by John Wiley and Sons in 1952.

The following procedure is used to determine whether or not a given yarn is "loop-forming". The filaments of a 1 meter sample of the yarn are bound tightly together at points spaced at 5 mm. intervals along the yarn sample, by small separate pieces of yarn encircling and tied about the yarn while the yarn is under a tension of 0.1 gram per denier. The yarn sample is placed while under no tension in an oven at 120° C. for 5 minutes, then removed from the oven and conditioned for 1 minute at 21° C. and 65% relative humidity. With one end of the sample supported by a clamp, a weight is applied to the other end of the sample so as to apply a tension of 0.1 grams per yarn denier. In yarns which are loop-forming, the filaments in the unrestrained yarn segments between successive pieces of string are not all in substantially continuous side-by-side contact as a single yarn bundle, but rather some filaments are substantially straight and under tension, while other filaments in the segments protrude outwardly from the straight filaments in the form of simple arcs or loops between adjacent pieces of string.

What is claimed is:

1. A package of yarn, said yarn consisting essentially of a plurality of polyester filaments having average shrinkages differing by less than 5%, said yarn comprising a plurality of polyester filaments which vary aperiodically in shrinkage along their lengths, said aperiodic shrinkage variation resulting from use of a spinning speed within the range of from about 3300 to about 5000 meters per minute, said filaments having elongations between 50% and 130%, deniers less than 4.5 and non-round cross-sections with major-to-minor axis ratios of at least 1.2; the number of said filaments, the locations and amplitudes of the local shrinkage levels along the lengths of said filaments, and differences in local shrinkage levels between adjacent filament segments along said yarn being correlated such that said yarn is loop-forming.

2. The yarn defined in claim 1, wherein said filaments consist essentially of poly(ethylene terephthalate).

3. The yarn defined in claim 2, wherein said yarn has a shrinkage less than 25%.

4. A package of loop-forming yarn, said yarn consisting essentially of a plurality of polyester filaments having average shrinkages differing by less than 5%, said yarn comprising a plurality of polyester continuous filaments having:

a. aperiodic within-filament shrinkage variations along their lengths, said aperiodic shrinkage variation resulting from use of a spinning speed within the rate of from about 3300 to about 5000 meters per minute;

b. within-filament and between-filament shrinkage C.V.'s of at least 10%;

c. deniers less than 4.5;

d. non-round cross-sections having major-to-minor axis ratios of at least 1.2; and e. elongations between 50% and 130%.

5. The yarn defined in claim 4, wherein said filaments consist essentially of poly(ethylene terephthalate).

6. The yarn defined in claim 5, wherein said between-filament shrinkage C.V.'s and within-filament shrinkage C.V.'s are at least 20%.

7. The yarn defined in claim 6, wherein said yarn has a shrinkage between 5 and 18%.

8. The yarn defined in claim 5, wherein said major-to-minor axis ratios are at least 1.5.

9. The yarn defined in claim 8, wherein said yarn has a shrinkage between 5 and 18%.

10. The yarn defined in claim 5, wherein said filaments have densities between 1.355 and 1.377.

11. The yarn defined in claim 10, wherein said yarn has a shrinkage between 5 and 18%.

12. The yarn defined in claim 5, wherein said densities are between 1.357 and 1.372.

13. The yarn defined in claim 12, wherein said yarn has a shrinkage between 5 and 18%.

14. The yarn defined in claim 5, wherein said filaments have deniers between 1 and 3.7.

15. The yarn defined in claim 14, wherein said yarn has a shrinkage between 5 and 18%.

16. The yarn defined in claim 5, wherein said yarn has a shrinkage between 5 and 18%.

17. The yarn defined in claim 5, wherein said filaments have spiral cross-sections.

18. The yarn defined in claim 5, wherein said filaments constitute a major portion of said yarn.

19. The yarn defined in claim 5, wherein said yarn consists essentially of said filaments.

* * * * *